United States Patent [19]

Holmes

[11] 4,171,474

[45] Oct. 16, 1979

[54] CURRENT INTERRUPTER ELECTRODE CONFIGURATION

[75] Inventor: Francis A. Holmes, Monroeville, Pa.

[73] Assignee: Electric Power Research Institute, Inc., Palo Alto, Calif.

[21] Appl. No.: 801,031

[22] Filed: May 27, 1977

[51] Int. Cl.[2] ..... H01H 33/66

[52] U.S. Cl. ..... 200/144 B; 200/147 R

[58] Field of Search ..... 200/144 B, 147 R

[56] References Cited

U.S. PATENT DOCUMENTS

| | | | |
|---|---|---|---|
| 2,922,926 | 1/1960 | Fehling | 361/14 |
| 3,071,667 | 1/1963 | Lee | 200/144 R |
| 3,211,866 | 10/1965 | Crouch et al. | 200/144 B |
| 3,283,103 | 11/1966 | Greenwood et al. | 200/147 R |
| 3,564,176 | 2/1971 | Fechant | 200/144 R |
| 3,716,685 | 2/1973 | Wilson | 200/147 R |
| 3,717,739 | 2/1973 | Kuhl et al. | 200/144 B |
| 3,773,993 | 11/1973 | Amsler | 200/144 B |
| 4,021,628 | 5/1977 | Kimblin | 200/147 R |

FOREIGN PATENT DOCUMENTS

| | | | |
|---|---|---|---|
| 45-20651 | of 1970 | Japan | 200/144 B |

*Primary Examiner*—Robert S. Macon

*Attorney, Agent, or Firm*—Flehr, Hohbach, Test et al

[57] ABSTRACT

A vacuum type current interrupter is provided having a low mass movable electrode which can be moved into electrical contact with a stationary electrode for carrying large currents associated with power lines. A third electrode is positioned in the vacuum envelope in opposing relation to the stationary electrode and adjacent the movable electrode. When the stationary and movable electrodes are separated an arc will appear between their contact surfaces. The third electrode is conductively connected to the movable electrode so that the arc will spread from the latter to the relatively larger surface of the third electrode, to reduce local overheating of the electrodes during arcing.

2 Claims, 4 Drawing Figures

CURRENT INTERRUPTER ELECTRODE CONFIGURATION

BACKGROUND OF THE INVENTION

The invention relates to current interrupters of vacuum type for use in controlling fault currents associated with transmission lines in power distribution systems.

Enormous increases in electrical power demand has led utility systems to use ever higher voltages in the transmission of power. Fault currents due, for example, to ground shorts can rapidly become enormous on such high voltage lines. Therefore, as transmission voltages rise there is a continuing need in the electric power industry for improved current interrupting and limiting devices capable of rapidly limiting fault currents which would otherwise seriously damage equipment.

Current interrupters are used to halt, or with a parallel current-suppressive load, to limit excessive currents customarily associated with faults. Interrupters of the vacuum type generally comprise a pair of relatively movable electrodes which can be placed in electrical contact to provide a free path for current flow. When excessive current is detected the contacts are separated, creating a voltage drop which generally induces arcing across the gap. The arc continues to carry substantially the full fault current. The arc must then be extinguished to prevent further current flow through the interrupter.

In the past it has been possible in alternating-current systems to permit the arc to burn until a current zero is reached, at which time the arc disappears and reignition prevented if the dielectric strength across the electrode gap is sufficient. In present high-voltage lines fault currents build up too rapidly to await even a single current half-cycle before extinguishing the arc. Instead, various techniques are employed to disrupt the current flow between electrodes immediately after separation. One technique is the application of a transverse magnetic field across the inter-electrode gap. The magnetic field tends to disrupt the arc so as to increase the voltage drop between the arcing electrodes. Such voltage drop will be sufficient either to break the flow of current or divert it into a parallel current-suppressive circuit which will limit the current below dangerous levels.

A problem encountered in magnetic arc suppression is local electrode overheating, particularly of the anode. The interelectrode gap immediately following separation is filled with a highly conductive neutral plasma comprising ions of cathode material and electrons. This plasma generally permits continuation of substantially the entire preseparation current flow with substantially no voltage drop. Ions emerge from the cathode at a multitude of infinitessimal emitting portions called "cathode spots". Application of a magnetic field causes these ions and associated electrons to be swept from between the electrodes greatly increasing the voltage drop across the arc and permitting current interruption. However, if there is overheating of the anode during arcing, it has been found that the anode also begins emitting conductive ions. Anodic ions emerge from "anode spots" which generate a conductive plasma similar to that from cathode spots, but which is far less susceptible to the magnetic field. Anode spots have been found to emit an ion-electron plasma in the form of a well collimated beam in which the ions emerge with sufficient energy to reach the cathode despite the magnetic field. This is thought to be due to the large fall region associated with the anode which permits rapid ion acceleration away from the anode. The arc emerging from the anode creates a permanent current path until the next current zero and is usually not extinguished by the magnetic field. Thus, successful rapid arc extinction is in part dependent upon reducing overheating of the anode and preventing anode spots.

It is known that relatively large electrode contact surfaces prevent bunching of the arc and hence reduce local overheating of the electrodes. To rapidly interrupt fault currents, however, it is necessary to separate the electrodes exceedingly rapidly, for example, 2 centimeters in one millisecond. Since large electrodes have a mass on the order of 2 kg or more, large separating forces are required, greatly increasing the cost of the interrupter.

Use of smaller mass electrodes with smaller contact surfaces tends to constrict the arc, this causes electrode overheating which leads to the development of anode spots and the failure of current interruption, as described above.

Use of a large fixed anode and small movable cathode greatly reduces the likelihood of anode spot formation. Unfortunately the polarity of voltage and current at the time of fault are unknown in alternating current applications.

OBJECTS AND SUMMARY OF THE INVENTION

It is an object of the invention to provide electrodes for a vacuum current interrupter in which the probability of anode spot formation is reduced.

Another object of the invention is to provide such an interrupter having at least one low mass electrode which may be rapidly moved to separate the contacting electrodes.

Still another object of the invention is to provide such a current interrupter having relatively large surfaces between which arcing occurs to prevent local overheating.

Accordingly, a current interrupter is provided for use in an electric power distribution system to protect against excessive current flow, having an evacuated envelope with three electrodes disposed therein. Two of the electrodes are in spaced relation and have opposed parallel faces. The remaining electrode is movable relative to the other electrodes. In one position a contacting portion of the movable electrode touches the face of one of the opposing electrodes to permit free current flow therebetween. Under fault conditions, or when current interruption is desired, the movable electrode is shifted to a position removed from the one opposing electrode. When in the latter position the contacting portion of the movable electrode is in proximity with the other opposing electrode. Both the last-named electrode and the movable electrode are conductively connected so that an arc appearing after electrode separation will spread to reduce local overheating of the electrodes. In its preferred form, the invention will additionally provide for application of a transverse magnetic field between the separated electrodes to rapidly extinguish the arc.

DESCRIPTION OF THE PREFERRED EMBODIMENT

Figure 1:
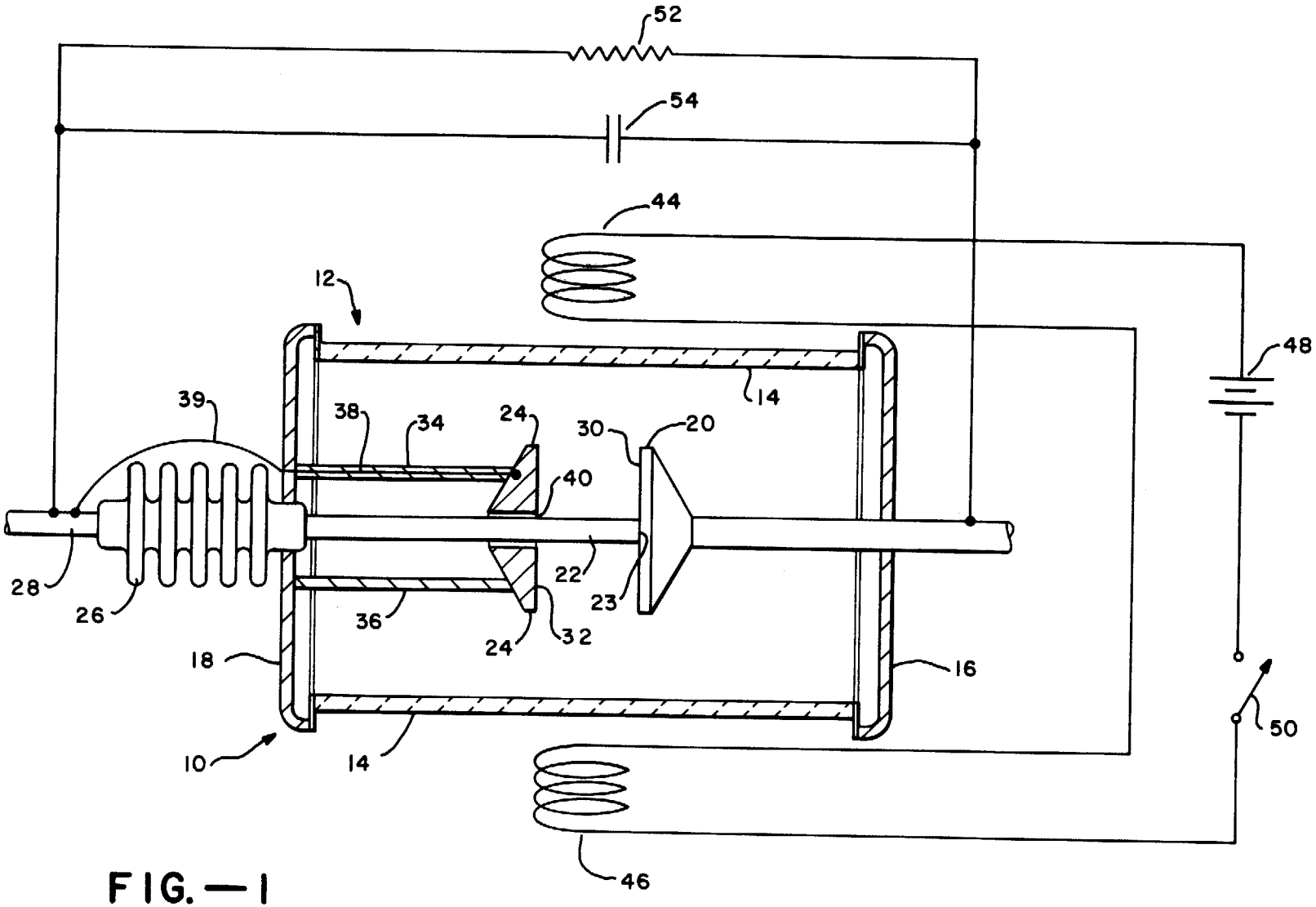
FIG. 1 is a cross sectional view through a vacuum-type current interrupter according to the invention with the electrodes in a closed position, also showing an associated current limiting circuit.

Referring to FIG. 1, current interrupter 10, according to the present invention, is installed as one parallel branch of a current limiting circuit. The current interrupter includes an evacuated envelope 12 having cylindrical walls 14 formed of insulating material such as glass or ceramic. The ends of cylinder 14 are closed by means of metallic end caps 16, 18 which are suitably sealed to walls 14 to define the vacuum envelope 12. Envelope 12 is evacuated to insure a mean free electron path sufficient to prevent gaseous breakdown between the electrodes when the electrodes are separated. For an electrode separation of approximately 2 centimeters the pressure should be lower than approximately $10^{-4}$ torr.

Disposed within the evacuated envelope are first, second, and third electrode members 20, 22 and 24. Electrode member 22 is movable relative to the other two electrodes whereby it can be moved into contact with member 20 to permit free flow of current. Electrodes 20 and 22 each extend through their respective end caps 16, 18 for interconnection with an associated power line on which the current is to be interrupted. When the electrodes are positioned as in FIG. 1, power line current flows through electrodes 20 and 22. Electrode 20 is suitably supported by and sealed to the end wall 16 to project into the envelope. Electrode 22 is movable and is supported by end wall 18 by bellows 26 having one end sealed to the wall 18 and the other end supporting the electrode. The bellows permits movement of the electrode while maintaining a vacuum within envelope. Suitable actuating means (not shown) are coupled to the outer end 28 of electrode 22 for moving electrode 22 between a first position in which the end portion 23 is in contact with electrode 20 to permit flow of current therebetween and a second position in which electrodes 20 and 22 are separated. The actuating means should be capable of rapid electrode separation, for example, separating electrodes the distance of 2 cm within 1 msec.

The third electrode 24 is suitably supported in the envelope such that electrodes 20 and 24 are in spaced relation and have opposed parallel faces 30 and 32. For example, the electrode 24 may be supported by support members 34, 36, preferably formed of insulating material, connected between the end wall 18 and the electrode 24 to support the electrode within the envelope. Electrode 24 is conductively connected to electrode 22. One such connection is illustrated by wire 38 running through support 34 connected to end cap 18 and wire 39 connected between the end cap and electrode 22. The electrodes 20 and 24 are therefore supported within the envelope from the end caps and have opposed parallel faces. The faces are preferably substantially identical in shape and periphery. In the preferred embodiment they are circular having substantially equal diameters. The electrode 24 has a centrally disposed opening adapted to receive the electrode 22.

Figure 4:
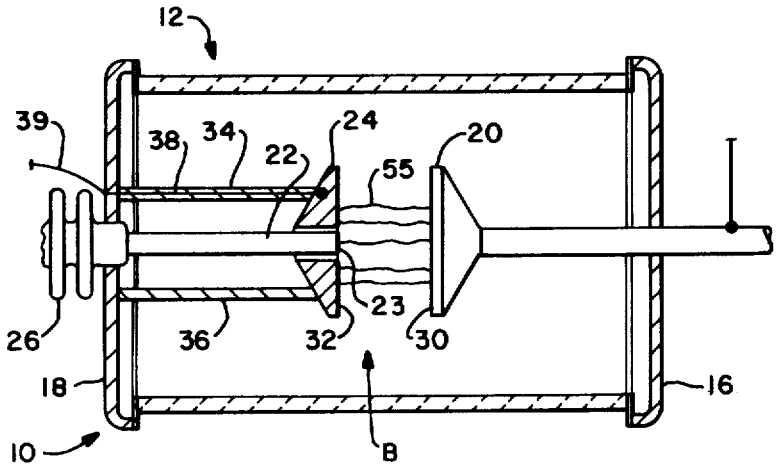
FIG. 4 is a cross sectional view as in FIG. 3 showing the arcing pattern after full electrode separation.

Electrode 22 is a movable rod, being disposed on and movable along an axis substantially perpendicular to face 30 of electrode 20 and extending through opening 40 in electrode 24. One end of the rod forms end portion 23 of electrode 22, which is adapted to contact face 30 of electrode 20 when electrode 22 is in its closed position. It is seen that electrode 22 has a low mass which permits rapid movement thereof along its axis with a minimum of energy and also has contact portion 23 substantially smaller than contact face 30. When electrode 22 is in its open position removed from contact with electrode 20 the portion 23 is in proximity with face 32 of electrode 24. That is, electrode 22 is withdrawn through opening 40 to a position where portion 23 is within opening 40. It is preferred that face portion 23 of electrode 22 comes to rest substantially coplanar with surface 32 of electrode 24 as shown in FIG. 4. As is known when the contacts of a vacuum interrupter are opened current continues to flow as an arc until the arc is extinguished. The energy generated by the arc tends to erode and damage the surfaces of the electrodes. If the arc is concentrated it overheats the electrodes and causes anode spots. By withdrawing the electrode 22 as described the portions on which the arc might tend to concentrate and cause overheating and the formation of anode spots is minimized.

To aid in extinguishing the arc which appears between the electrodes following separation, coils 44 and 46 are disposed outside envelope 12. The coils preferably have an independent power supply 48 and are energized by switch 50. The coils provide means for producing lines of magnetic force extending transversely between faces 30 and 32. Such lines of magnetic force aid in rapidly extinguishing the arc appearing between the electrodes following separation.

The preferred embodiment current interrupter 10, is placed in parallel with a current limiting circuit adapted to rapidly reduce excessive current flow. Such current-suppressive circuit comprises resistor 52 in parallel with capacitor 54. This circuit serves to maintain the current flowing therethrough within safe limits, after the current path through interrupter 10 is opened.

In operation, the current interrupter is placed on line in a power distribution line with electrodes 20 and 22 in mutual contact, as shown in FIG. 1. Current flows freely between the electrodes with practically zero voltage drop causing no current to be diverted to parallel resistor 52 and capacitor 54.

Figure 2:
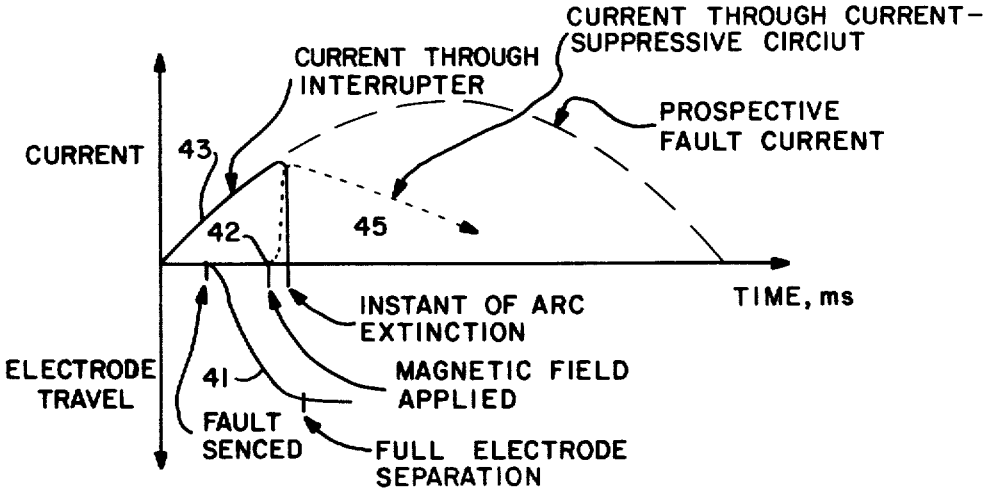
FIG. 2 is a diagrammatic representation of various parameters within the interrupter envelope and their changes with respect to time.
Figure 3:
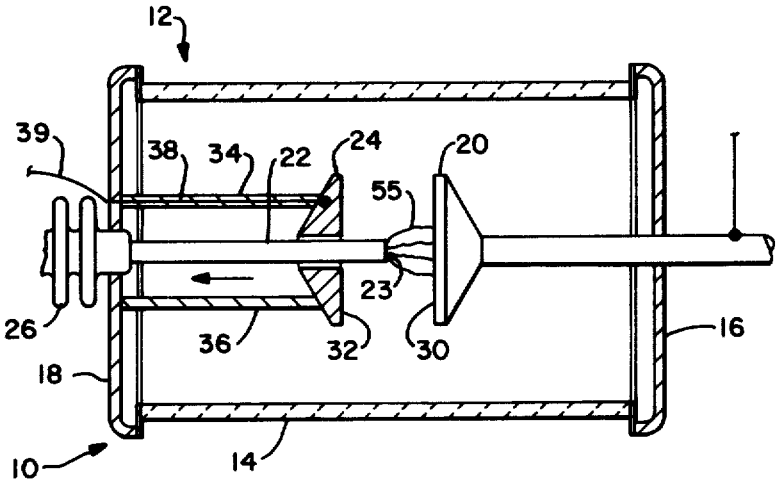
FIG. 3 is a partial cross sectional view as in FIG. 1 showing the arcing pattern immediately following initial electrode separation.

Referring to FIG. 2, when a line fault occurs, generally by way of a substantial current path to ground, the current through the interrupter rises rapidly. When apparatus (not shown) monitoring line current indicates a fault condition, a signal is sent to an actuator which moves the electrode 22 to separate electrodes 20 and 22. Electrode separation proceeds over a finite time span, as indicated by curve 41 in FIG. 2. FIG. 3 illustrates the position of electrode 22 after separation and prior to full separation with arcing begun between the electrodes. As electrodes 20 and 22 approach full separation the arc will extend to and spread onto electrode 24 as shown in FIG. 4. Such spreading serves to disperse the arc thereby reducing overheating of the electrodes in any localized region. A magnetic field is applied by coils 44 and 46 prior to full separation in a direction transverse to the faces of the electrodes, as indicated by the arrow B in FIG. 4. As shown in FIG. 2 the onset of the magnetic field at 42 rapidly diverts the fault current 43 into the current-suppressive parallel circuit. When the arc is completely extinguished, the current 45 through the parallel suppressive circuit is rapidly limited and decreases steadily.

The mechanism for spreading the arc is essentially the same regardless of the polarity of the electrodes at the instant of separation. If electrode 22 is the instantaneous cathode, arcing proceeds from portion 23 to face 30, with the ions emitted from portion 23. As electrode 23 becomes fully retracted, ion emitting portions spread to face 32 of electrode 24. In either position face 30 forms an anode collection area which is sufficiently large to insure against formation of anode spots. If the current is flowing in the opposite direction electrode 20 becomes the cathode with the ion emitting portion spread over an area slightly larger than portion 23 on face 30, as seen in FIG. 3. The anode collection area is initially restricted to portion 23 but it has been experimentally confirmed that collection quickly spreads down the stem of electrode 22 as it retracts into surface 32 of electrode 24. It subsequently spreads over surface 32 as shown in FIG. 4. The spreading of the anode from portion 23 is rapid enough to prevent the formation of anode spots during separation. Consequently, regardless of electrode polarity ion emission patterns and arcing proceeds as shown in FIGS. 3 and 4.

Other embodiments of circuit interrupters are possible having electrodes according to the invention, including variations in the shape of the electrodes and in the relationship between electrodes 22 and 24. It would, for example, be possible to place the opening in electrode 24, through which the movable electrode passes, in other than the center of electrode 24. Electrodes 20 and 24 could likewise be of a shape other than circular. Furthermore, it is possible to permit retraction of electrode 22 beyond the limit of that suggested in FIG. 4 such that the portion 23 is further from surface 30 than is surface 32. It should therefore be understood that while a particular embodiment of a current interrupter electrode configuration has been shown, various modifications and changes may be made within the scope of this invention.

There has been provided a current interrupter in which the movable electrode has minimum mass and can be rapidly moved with minimum energy while still providing larger surfaces for the arc discharge.

What is claimed is:

1. A current interrupter for use in an electric power distribution system to protect against excessive current flow, comprising: an evacuated envelope, first, second and third electrode members disposed within said envelope, said first and third electrode members being spaced apart and having opposed substantially flat parallel faces, said third electrode member having a central opening through said face, said second electrode member being disposed in said central opening and having a contact portion substantially smaller than said face of said first electrode member to minimize the mass of said second electrode member, said second electrode member being movable from a first position in which said second electrode member extends through said central opening and said contact portion contacts the opposed first electrode member centrally to a second position in which said first and second electrode members are spaced apart a distance at least as great as the distance between said first and third electrode members, the separation between said first and second electrode members being at least two centimeters in said second position and the interrupter being adapted to achieve said two centimeter separation from said first position in one millisecond or less, the low mass of said second electrode member minimizing the motive force required to rapidly move said second electrode member from said first to said second positions, and means for producing lines of magnetic force between and substantially parallel to said opposed faces of said first and third electrode members to extinguish arcing between said electrode members within one-half cycle of the operating frequency of the power distribution system.

2. A current interrupter as in claim 1 in which said second electrode member is rod-shaped and oriented along an axis substantially perpendicular to said parallel faces of said first and third electrode members and is movable along said axis.

* * * * *